US006976605B2

(12) United States Patent
Mitchell et al.

(10) Patent No.: US 6,976,605 B2
(45) Date of Patent: Dec. 20, 2005

(54) DISPENSER FOR SHEET MATERIAL

(75) Inventors: Joseph Mitchell, Alpharetta, GA (US); Debra N. Welchel, Woodstock, GA (US); Herb F. Velazquez, Neenah, WI (US); Tim J. Morton, Chicago, IL (US); Joel G. Delman, Chicago, IL (US); Melanie L. Andres, Chicago, IL (US); John B. Freese, Evanston, IL (US); Donna Ann Piacenza, Chicago, IL (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 334 days.

(21) Appl. No.: 10/439,443

(22) Filed: May 16, 2003

(65) Prior Publication Data

US 2005/0077309 A1 Apr. 14, 2005

(51) Int. Cl.[7] ..... B65H 1/00
(52) U.S. Cl. ..... 221/45; 221/199
(58) Field of Search ..... 221/34, 45, 33, 221/199; 242/570, 588.3; 206/233, 747, 206/749, 750

(56) References Cited

U.S. PATENT DOCUMENTS

| | | | | |
|---|---|---|---|---|
| 1,925,102 | A * | 9/1933 | Levkoff | 206/746 |
| 2,122,048 | A | 6/1938 | Shapiro | |
| 2,765,909 | A | 10/1956 | Graham | |
| RE24,906 | E | 12/1960 | Ulrich | |
| 3,090,271 | A * | 5/1963 | Castelli | 83/614 |
| 3,612,264 | A | 10/1971 | Trunick | |
| 3,824,953 | A | 7/1974 | Boone | |
| 3,836,044 | A | 9/1974 | Tilp et al. | |
| 3,837,595 | A | 9/1974 | Boone | |
| 3,921,802 | A | 11/1975 | Thompson | |
| 3,986,479 | A | 10/1976 | Bonk | |
| 3,995,582 | A | 12/1976 | Douglas | |
| 4,106,616 | A | 8/1978 | Boone | |
| 4,106,617 | A | 8/1978 | Boone | |
| 4,235,333 | A | 11/1980 | Boone | |
| 4,610,357 | A | 9/1986 | Nakamura | |
| 4,620,502 | A | 11/1986 | Kimble | |
| 4,638,921 | A | 1/1987 | Sigl et al. | |
| 4,651,874 | A | 3/1987 | Nakamura | |
| 4,739,879 | A | 4/1988 | Nakamura | |
| 4,834,316 | A | 5/1989 | DeLorean | |
| 4,865,221 | A | 9/1989 | Jackson et al. | |

(Continued)

FOREIGN PATENT DOCUMENTS

| | | |
|---|---|---|
| CA | 2305110 | 10/2001 |

(Continued)

*Primary Examiner*—David H. Bollinger
(74) *Attorney, Agent, or Firm*—Sue C. Watson; Scott A. Baum

(57) ABSTRACT

A dispenser adapted to dispense sheets as a table top dispenser and convertible into a dispenser configured to dispense sheets from a conventional rolled product fixture is provided. The dispenser includes a housing having sheets provided therein and at least one opening oriented to dispense sheets therefrom. The housing is adapted to be positioned on a horizontal surface such as a table top and dispenses sheets therefrom. The housing includes a platform positioned thereover which is masked due to its appearance as providing at least a portion of the housing. The dispenser is converted into a dispenser for dispensing sheets from a conventional rolled product fixture when the platform is released. The platform is pivotably moved on an axis and a portion of the platform is positioned against the housing such that the housing is supported above the platform on a fixture for dispensing sheets therefrom when coupled thereto.

47 Claims, 7 Drawing Sheets

U.S. PATENT DOCUMENTS

| | | | | |
|---|---|---|---|---|
| 4,913,312 | A | 4/1990 | Boutin | |
| 5,265,758 | A | 11/1993 | Saint Criq et al. | |
| 5,311,986 | A | 5/1994 | Putz | |
| 5,409,181 | A | 4/1995 | Patrick | |
| 5,439,521 | A | 8/1995 | Rao | |
| 5,618,008 | A | 4/1997 | Dearwester et al. | |
| 5,660,636 | A | 8/1997 | Shangold et al. | |
| 5,765,717 | A | 6/1998 | Gottselig | |
| 5,894,933 | A * | 4/1999 | Crews et al. | 206/750 |
| 5,897,074 | A | 4/1999 | Marino | |
| 5,950,960 | A | 9/1999 | Marino | |
| 5,951,762 | A | 9/1999 | Shangold et al. | |
| 6,047,920 | A | 4/2000 | Dearwester et al. | |
| 6,056,235 | A | 5/2000 | Brozinsky | |
| 6,098,836 | A | 8/2000 | Gottselig | |
| 6,170,698 | B1 | 1/2001 | Phelps et al. | |
| 6,230,929 | B1 | 5/2001 | Phelps et al. | |
| 6,283,291 | B1 * | 9/2001 | Vasudeva et al. | 206/373 |
| 6,328,252 | B1 | 12/2001 | Neveu et al. | |
| 6,346,153 | B1 | 2/2002 | Lake et al. | |
| 6,382,552 | B1 | 5/2002 | Paul et al. | |
| 6,439,386 | B1 | 8/2002 | Sauer et al. | |
| 2002/0063136 | A1 | 5/2002 | Sauer et al. | |
| 2002/0092789 | A1 | 7/2002 | Sauer et al. | |
| 2003/0075551 | A1 | 4/2003 | Dailey, III | |
| 2003/0192903 | A1 | 10/2003 | Sauer et al. | |

FOREIGN PATENT DOCUMENTS

| | | |
|---|---|---|
| EP | 0459110 | 12/1991 |
| EP | 0568987 | 7/1997 |
| EP | 1129656 A1 | 9/2001 |
| GB | 2270901 | 3/1994 |
| WO | 94/14365 | 7/1994 |
| WO | 98/04486 | 2/1998 |
| WO | 00/65973 | 11/2000 |
| WO | 01/76436 | 10/2001 |
| WO | 01/76440 | 10/2001 |
| WO | WO 01/76439 | 10/2001 |
| WO | 01/89935 | 11/2001 |
| WO | 02/21988 | 3/2002 |
| WO | 02/21989 | 3/2002 |

* cited by examiner

DISPENSER FOR SHEET MATERIAL

BACKGROUND OF THE INVENTION

The use of single sheets provided as interfolded sheets for facial tissue and bath tissue has been widely accepted. Such single stacked, interfolded or festooned sheets often provide less waste than traditional rolled bath tissue. Similarly, the use of premoistened or "wet" sheets has also gained wide acceptance for a variety of uses, particularly premoistened bathroom applications. Dry sheets and premoistened sheets are generally formed from an absorbent material such as a paper or a polymeric web, or combinations thereof, and may contain a disinfectant, medicant, deodorant, anti-microbial, anti-bacterial, cleansing agent, and so forth, in one or more combinations, on a dry sheet, or in a "wet" formulation on a premoistened sheet. Premoistened sheets are generally stored and dispensed from a sealable container to prevent the sheets from drying out.

Various dispenser designs for dry or premoistened sheets have been used for table top use in various rooms of a user's home. In addition, various dispenser designs for dry or premoistened sheets have been used in a user's bathroom. However, most table top dispenser designs do not adapt well to use in a conventional rolled product fixture. Similarly, dry or premoistened sheets designed for use with bathroom fixtures have not been readily adaptable for table top use in other areas of a user's home.

Accordingly, it would be desirable to provide a dispenser capable of dispensing dry and/or premoistened sheets from a table top in a user's home, which would easily convert into a dispenser which may be quickly and easily attached to a conventional rolled product fixture used for toilet tissue. In addition, it would be desirable to provide a non-refillable, disposable dispenser that is adapted for use with such a fixture.

DEFINITIONS

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

These terms may be defined with additional language in the remaining portions of the specification.

SUMMARY OF THE INVENTION

In response to the difficulties and problems discussed above, a dispenser adapted to dispense sheets as a table top dispenser and convertible to a dispenser configured to dispense sheets from a conventional rolled product fixture is provided. The dispenser includes a housing having sheets provided therein and at least one opening oriented to dispense sheets therefrom. The housing is adapted to be positioned on a horizontal surface such as a table top. The housing includes a platform positioned thereover which is masked due to its appearance as providing at least a portion of the housing. The dispenser is converted into a dispenser for dispensing sheets from a conventional rolled product fixture when the platform is released. The platform is pivotably moved on an axis and a portion of the platform is positioned against the housing such that the housing is supported above the platform on a fixture for dispensing sheets therefrom.

DETAILED DESCRIPTION

Figure 1:
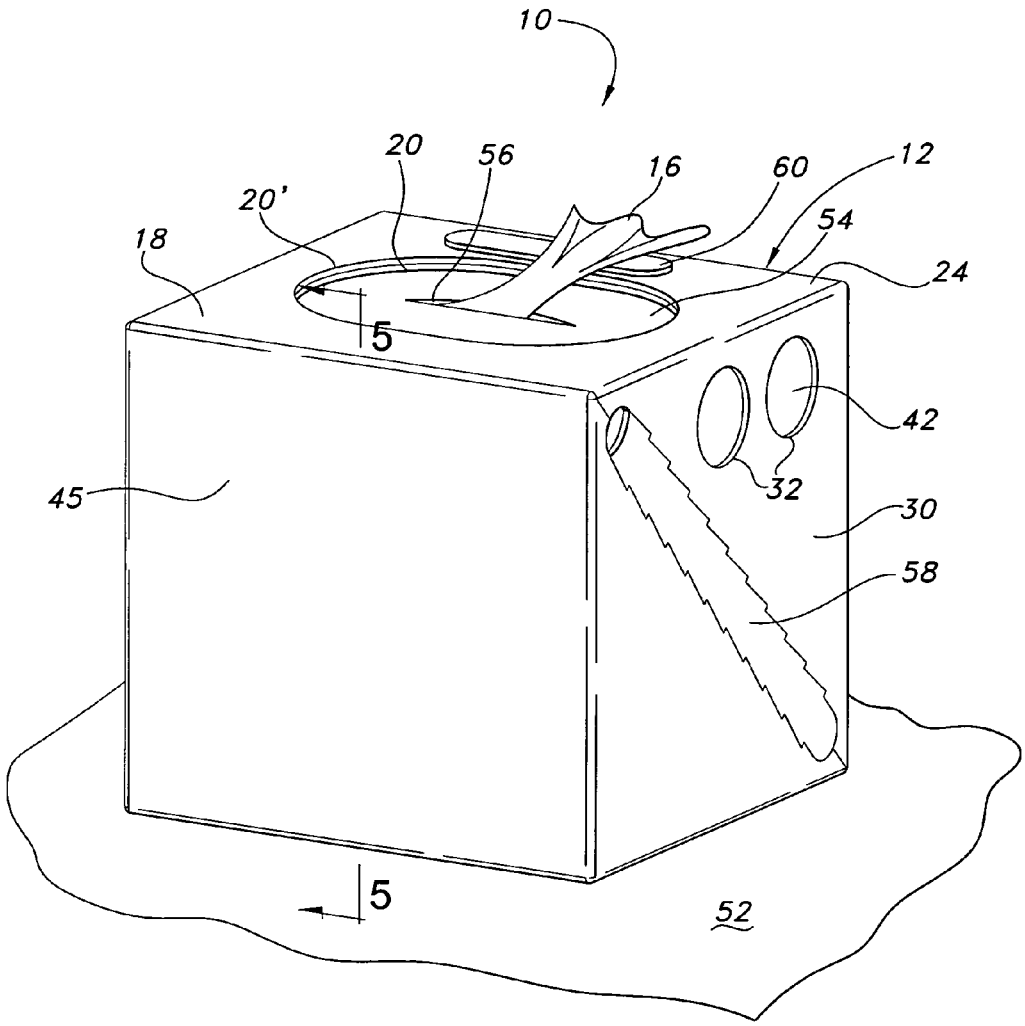
FIG. 1 is a perspective view of an embodiment of the dispenser of the present invention, showing the dispenser in its dispensing position on a substantially horizontal surface for dispensing dry sheets therefrom.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to the figures in general, a dispenser is provided for storing and dispensing sheets. It should be appreciated that the present invention is not limited to any particular type of sheets. The dispenser, however, is well suited for dispensing, by way of non-limiting example, individual stacked, interfolded sheets, as generally illustrated in the figures. Non-limiting examples of dry sheets are disclosed in U.S. Pat. No. 3,301,746 to Sanford et al., U.S. Pat. No. 3,322,617 to Osborne, U.S. Pat. No. 5,048,589 to Cook et al., U.S. Pat. No. 5,399,412 to Sudall et al., U.S. Pat. No. 5,607,551 to Farrington et al., and U.S. Pat. No. 5,672,248 to Wendt et al., all of which are incorporated by reference herein in their entirety. Non-limiting examples of premoistened sheets are disclosed in U.S. Pat. Nos. 4,741,944 and 4,865,221, both to Jackson et. al., U.S. Pat. No. 5,629,081 to Richards et al., U.S. Pat. No. 5,656,361 to Vogt et al., and U.S. Pat. No. 5,964,351 to Zander, all of which are incorporated by reference in there entirety herein. Such stack configurations for dry sheets, such as toilet tissue and facial tissue, and/or premoistened sheets are well known to those of ordinary skill in the art and need not be described in great detail herein.

As illustrated in FIGS. 1–5, a dispenser 10 according to the invention is provided for desirably, but not by way of limitation, dispensing dry sheets 12. In addition, the dry sheets 12 are desirably interfolded, stacked, and/or festooned, with or without perforations, and so forth.

Figure 4:
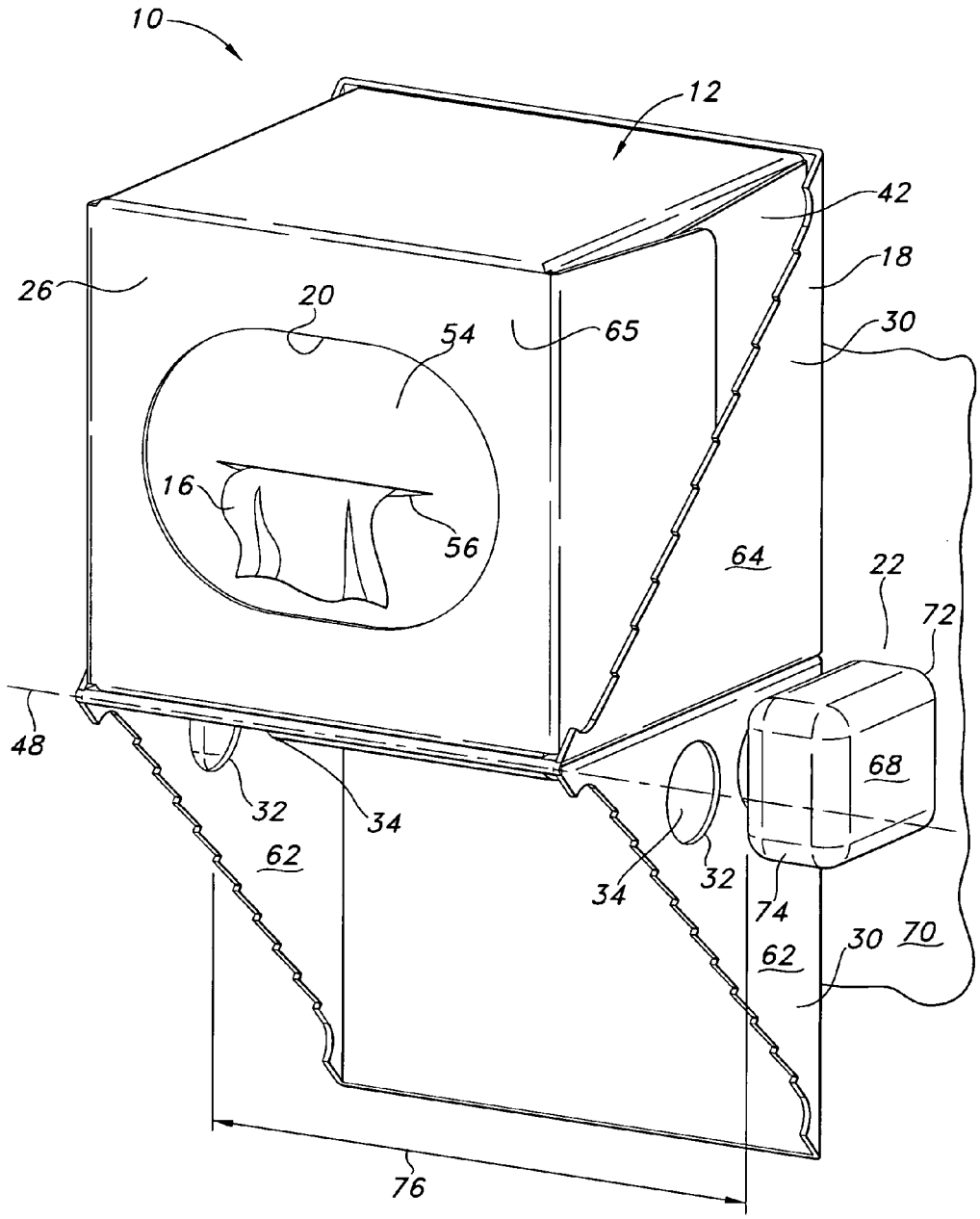
FIG. 4 is a prespective view of the dispenser of FIG. 3, showing the dispenser in its dispensing position releasably coupled to a roll mount of a conventional rolled product fixture for dispensing dry sheets therefrom.
Figure 5:
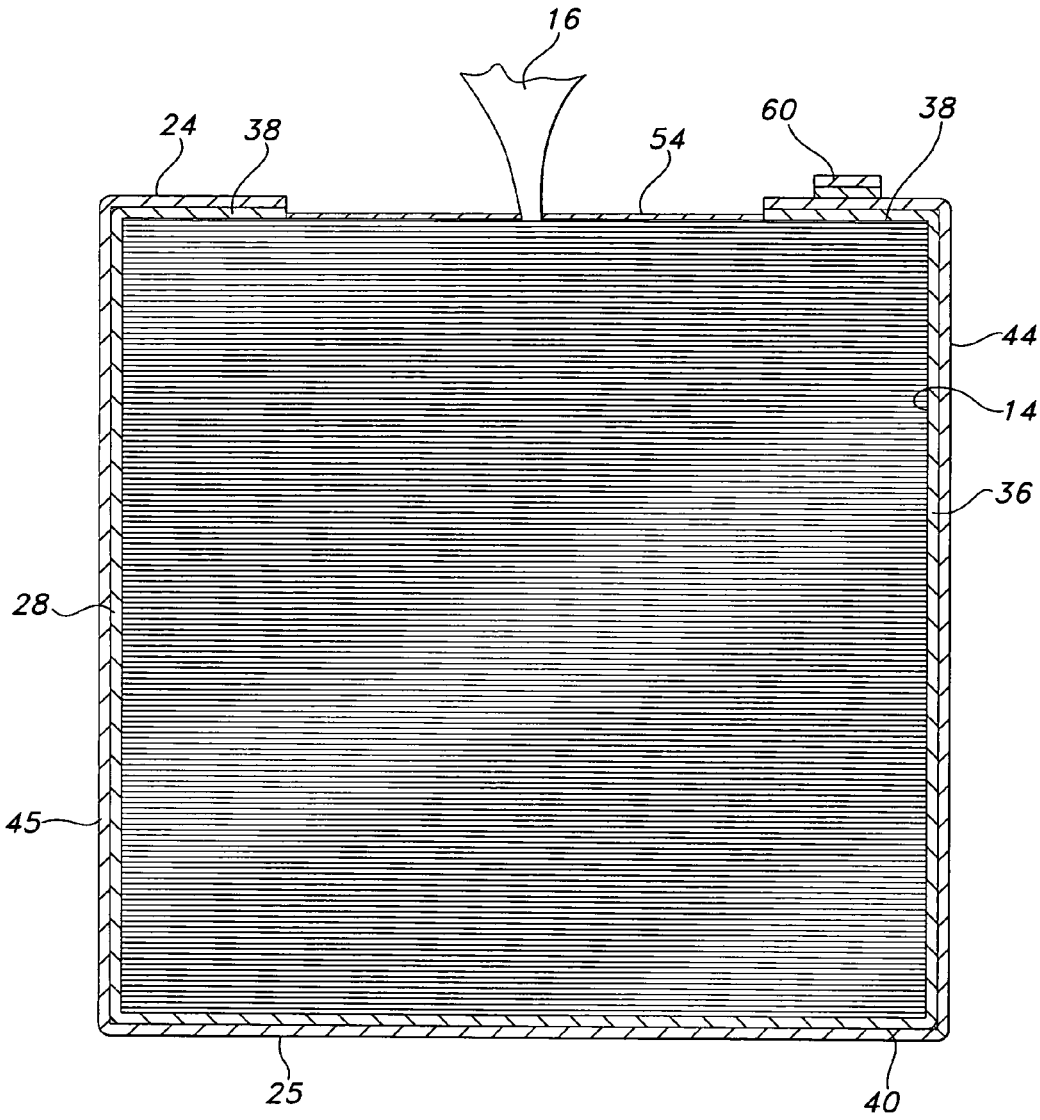
FIG. 5 is a sectional view of FIG. 1 taken along line 5—5.

As shown in FIGS. 1 and 5, The dispenser 10 includes a housing 12 which provides a compartment 14 in which sheets, in this non-limiting example dry sheets 16, are stored and dispensed. Dispensing openings 20, 20' are defined in the housing 12 and a support member 18, respectively, to permit access to the dry sheets 16 disposed in the compartment 14. The housing 12, as illustrated in FIGS. 2–5, is essentially a box within a box which may be used for table top dispensing. The outer box of the housing 12 separates into two halves when a release strip 58 is pulled. The two halves are formed diagonally across sidewalls 30. In this instance, one half of the outer box remains attached to the housing. The other half, which may remain pivotally attached along one edge of the housing 12, detaches and moves below the housing 12 (FIGS. 2–4) to provide a platform or a support member 18 for the housing. The support member permits the housing 12 to be coupled to a conventional rolled product fixture 22.

Figure 2:
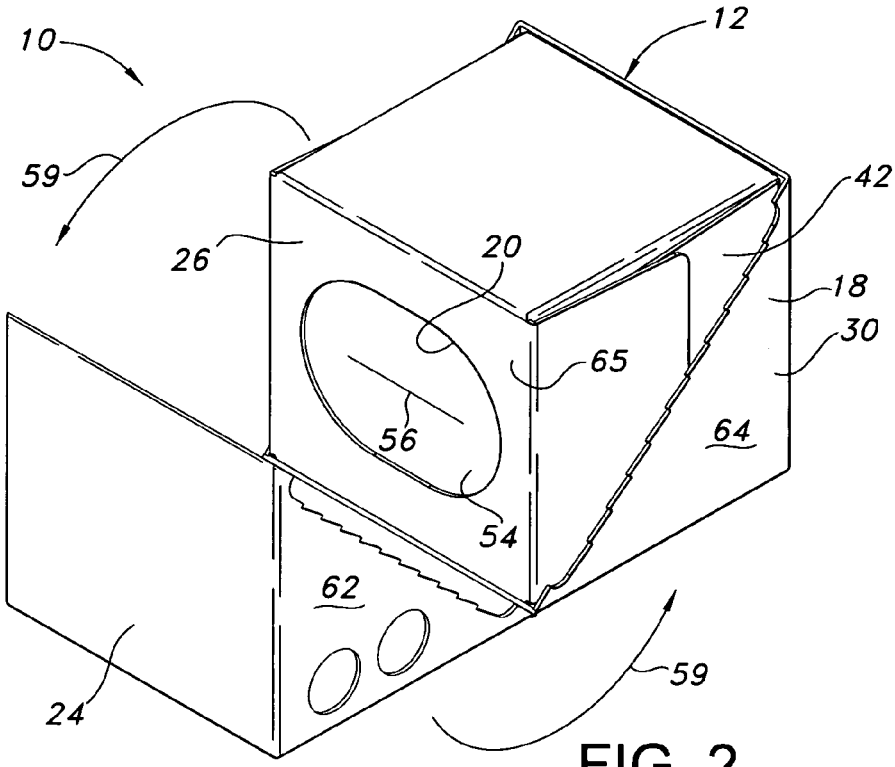
FIG. 2 is a perspective view of the embodiment of FIG. 1, showing the dispenser being converted from a table top dispenser to a dispenser which coupled to a conventional rolled product fixture.
Figure 3:
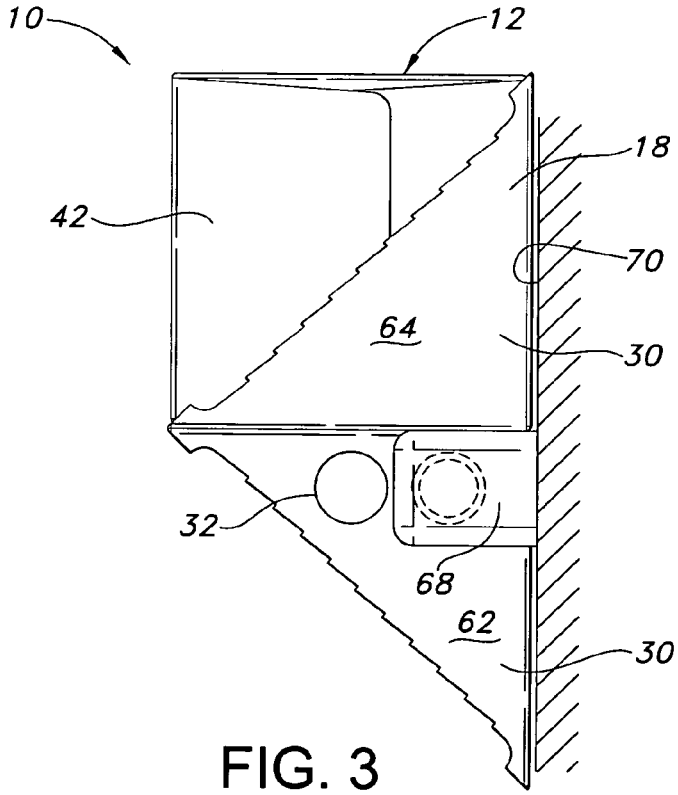
FIG. 3 is a side view of the embodiment of FIG. 1, showing the dispenser converted to a dispenser coupled to a conventional rolled product fixture.

When the platform or support member 18 is moved away from the housing 12, it is moved in a direction 59 such that an upper surface 24 of the support member 18 is positioned against another outer surface 26 of a front wall 28, as shown in FIGS. 2–4. The support member 18 may be held in this position by a bonding material, for example, an adhesive. Sidewalls 30 of the support member 18 desirably include one or more apertures 32 which permit a roll mount 34 of a fixture 22 to extend therethrough to releaseably couple the dispenser 10 to the fixture 22. The dispenser 10 is positioned above the roll mount 34 of the fixture 22, for dispensing dry sheets 16 therefrom.

Turning now to the structures of the dispenser, the housing 12, as shown in FIG. 5, includes front and back walls 28, 36 and upper and lower ends 38, 40. As illustrated in FIGS. 1–4, sidewalls 42 cooperate with the front and back walls 28, 36 and upper and lower ends 38, 40 to provide the housing 12. The housing 12 is formed, however, with the support member 18 which is positioned over at least a portion of the housing 12.

The support member 18 (FIGS. 1, 2 and 5) includes an upper surface 24 and a lower surface 25 and spaced-apart sidewalls 30. The support member 18 also includes a back wall 44 that is provided adjacent the upper surface 24 and sidewalls 30. The support member 18 may include a front wall 45 which is positioned over and attached to the front wall 28 of the housing 12. The support member 18 may be coupled to or otherwise attached to the housing 12 by a portion (not shown) which is positioned against and coupled or attached to the front wall 28 of the housing 12. The support member 18 may pivot on an axis 48 provided at junction 50 of the support member 18 and the front wall 28 of the housing 12. Such pivotable movement is provided by sufficiently resilient material in at least this portion of the support member 18, by a hinge, such as a living hinge, and so forth. Alternatively, the support member 18 may be detached but used in the same manner to support the housing 12 (not shown).

The dispenser 10 may be disposed on a generally horizontal surface 52, such as, by way of non-limiting example, a table top, to permit dry sheets 16 to be dispensed therefrom (FIG. 1). Such use is compatible with use of the dry sheets 16 for facial tissue, and so forth, in any room of a user's home. The dispenser 10 is desirably positioned such that the dry sheets 16 are preferably dispensed from an upper portion of the dispenser 10 when it is positioned on a horizontal surface, such as a table top. In this position, the support member 18 is masked or hidden in plain view of the user due to its appearance as providing at least a portion of an upper surface and sidewalls of the housing 12. Such a structure masks or hides the use and function of the support member 18 as well.

The dispensing openings 20, 21' desirably are provided in an upper end 38 of the housing 12 and the upper surface 24 of the support member 18, respectively. One or more dispensing openings, however, may be provided, however, in any wall, structure, and/or combination thereof in the housing 12 and/or support member 18 in any embodiment herein to permit dispensing of any sheet(s) shown and/or described herein. It will be appreciated that the dispensing openings 20, 20' may take any suitable shape and configuration. One or more dispensing openings shown and/or described herein may be covered, for example, but not by way of limitation, by a plastic film 54 having a slit 56 to provide access to the dry sheets 16, and so forth. In another alternative, one or more dispensing openings may be formed from perforated portions that, when removed, provide the openings (not shown), and so forth.

When the dispenser 10 is disposed on the horizontal surface 52, the dispensing openings 20, 20' therein are desirably disposed in a superior or higher position, to dispense dry sheets 12 for use as facial tissue, and so forth. Structures of the dispenser 10 which do not have a dispensing opening therein are desirably positioned in an inferior or lower position. However, as often occurs in a bathroom, it may be desirable to have a dispenser 10 which is suitable for dispensing dry sheets 16 for use as bath or toilet tissue. In this instance, it may be desirable to have one or more dispensing openings oriented at a different level. The dispenser 10 easily adapts to this task, converting for use to dispense dry sheets 12 for toilet tissue and releasably coupling to a conventional rolled product fixture 22.

The support member 18 is releasably attached to the housing 12 by a release member or release strip 58 (FIG. 1), which may include, by example, and not by way of limitation, a tear-off strip, a release strip, an adhesive seal, and so forth. In addition, the support member 18 may desirably have a seal or peel strip 60, which may cover an adhesive disposed on the upper surface 24 of the support member 18.

When the release strip 58 is pulled, it separates a portion of the sidewalls 30 of the support member 18 such that the back wall 44, the upper surface 24 and an adjacent generally first triangular portion 62 of the sidewall 30 separate from the sidewall 30 and from the remainder of housing 12, as shown in FIG. 2. The support member 18 pivots on the axis 48 and in the direction 59 which permits the upper surface 24 of the support member 18 to pivotably move such that the upper surface 24 of the support member 18 and the upper end 38 of the housing 12 are positioned at about a 90 degree angle with respect to each other. The angle is supported by each triangular portion 62 of the sidewall 30, each of which desirably provides a 90 degree angle therein. Each first triangular portion 62 also provides at least one acute angle therein. Desirably, the peel strip or seal 60 is also removed from the upper surface 24 of the support member 18 such that the adhesive, such as, by way of non-limiting example, a pressure sensitive adhesive, and so forth, is exposed.

The upper surface 24 of the support member 18 is pivotably moved or rotated in a direction 59 more than about 180 degrees. Desirably, the upper surface 24 of the support member 18 is pivotably moved more than about 200 degrees. Even more desirably, it is moved more than about 250 degrees. Yet even more desirably, it is moved to about 270 degrees from its initial position against the upper end 38 of the housing 12. Alternatively, it moves until it rests against the front wall 28 of the housing 12 and desirably adhesively couples thereto.

In this orientation, as shown in FIGS. 3 and 4, the first triangular portion 62 is positioned adjacent a second triangular portion 64 which is the portion of each sidewall 30 of the support member 18 which remained attached to the sidewall 42 of the housing 12. The upper end 38 of the housing 12 during this process is also turned about 90 degrees to the front to provide the dispensing opening 20 on the side, in this instance, a front side 65, of the dispenser 10. The dispensing opening 20 is therefore provided to a lower or more inferior level than the a higher or more superiorly oriented structure when dispensing from a table top. The support member 18 provides a platform for mounting the housing 12 to the fixture 22 to permit the dispenser 10 to dispense dry sheets 12 for use as toilet tissue sheets. Each first triangular portion 62 of the sidewall 30 of the support member 18 has at least one aperture 32 therein, to permit a roll mount 34 of a fixture 22 to extend therethrough.

Such a fixture 22, as illustrated in FIG. 4, has at least a pair of side support arms 68 mounted to and extending transversely from a generally vertically disposed support surface 70. Alternatively, the support arms 68 are coupled to a base or back member (not shown). Each of the side support arms 68 extends from a coupled end 72 to a free end 74 of the support arm 68, which often has a recess therein (not shown). In addition, the support arms 68 have a width dimension 76 which extends between the support arms 68. Typically, a roll mount 34 extends across this width dimension 76 to releasably couple to the support arms 68. The roll mount 34 typically includes a protruding member on each end (not shown). The protruding member is desirably releasably positioned in the recess of the support arm 68 to suspend the roll mount 34 between the support arms 68. The roll mount 34 in the present embodiment, for example, is a conventional spindle. As used herein, the term "roll mount" includes a spindle, and also includes a pair of prongs mounted on each support arm in a confronting relationship, such that may be used with a coreless bath tissue roll, such as, by way of example and not limitation, the one illustrated and described in detail in U.S. Pat. No. 5,620,148 to J. Mitchell, which is hereby incorporated by reference in its entirety herein.

The roll mount 34 is positioned through at least one opening 66 in each first triangular portion 62 of the support member 18 and coupled to the support arms 68, as shown in FIGS. 3 and 4. The dispenser 10 in this position has been converted from a dispenser for moveable table top, horizontal surface 52 use in any room of a user's home to a fixed dispenser 10 for dispensing individual dry sheets 12 for use, for example, as bath tissue sheets, from a conventional rolled product fixture 22 in a user's bathroom.

In the embodiments illustrated herein, the width dimension 76 between the support arms 68 also determines at least a portion of a width dimension 78 of at least the portion of the support member 18 which is positioned between the support arms 68 and coupled to the roll mount 34. The width dimension 76 between the support arms is typically in a range of about 6.0 inches to about 4.0 inches.

The width dimension 78 of the portion of the support member 18 which is positioned between the support arms 68 is desirably, in a range of about 5.5 inches to about 4.7 inches. Even more desirably, the width dimension 78 is in a range of about 5.25 inches to about 4.6 inches. Yet even more desirably, the width dimension 78 is in a range of about 5.25 inches to about 4.5 inches.

Any portion of the housing 12 may include an opening therein (not shown) which reveals the amount of remaining dry sheets 16 contained in the compartment 14. Such an opening provides an indication of whether there is sufficient dry sheets 16 for use in the compartment 14, or whether a refill may be needed.

The housing 12 may desirably be non-refillable, and when the sheets (dry and/or premoistened) are removed therefrom, the dispenser 10 is disposed of. However, the housing 12 may be provided as a refillable housing. It refillable, the housing will open along the junction of at least surface or wall (not shown), which is coupled to the housing by hinges, such as living hinges, fasteners, latches, and so forth, to permit access and closure to the compartment.

The housing 12 may be formed from any conventional material, such as, but not by way of limitation, metal, plastic, wood, and combinations thereof, and so forth. The housing 12 may also be provided from a relatively inexpensive cardboard, paperboard, plastic, any combinations thereof, and so forth. The housing 12 may be provided in any shape or configuration, and the present embodiment is provided only as one non-limiting example thereof.

If the dispenser 10 permits refilling, a group of sheets (dry and/or premoistened) are disposed in the compartment 16. Desirably, the sheets may, by way of non-limiting example, be provided as a cartridge and/or a container of sheets (not shown).

Figure 6:
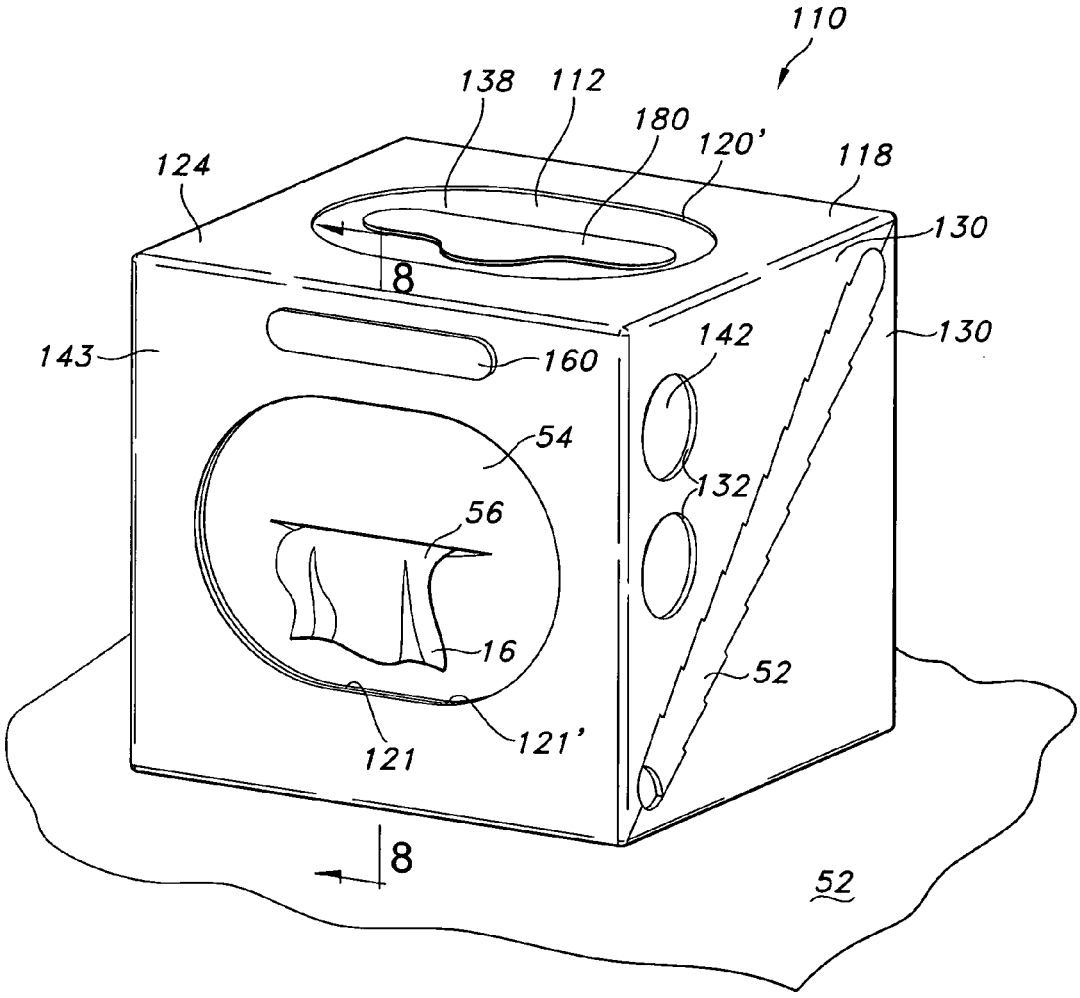
FIG. 6 is a perspective view of another embodiment of the dispenser of the present invention, showing the dispenser in its dispensing position on a substantially horizontal surface for dispensing dry sheets and premoistened sheets therefrom.
Figure 7:
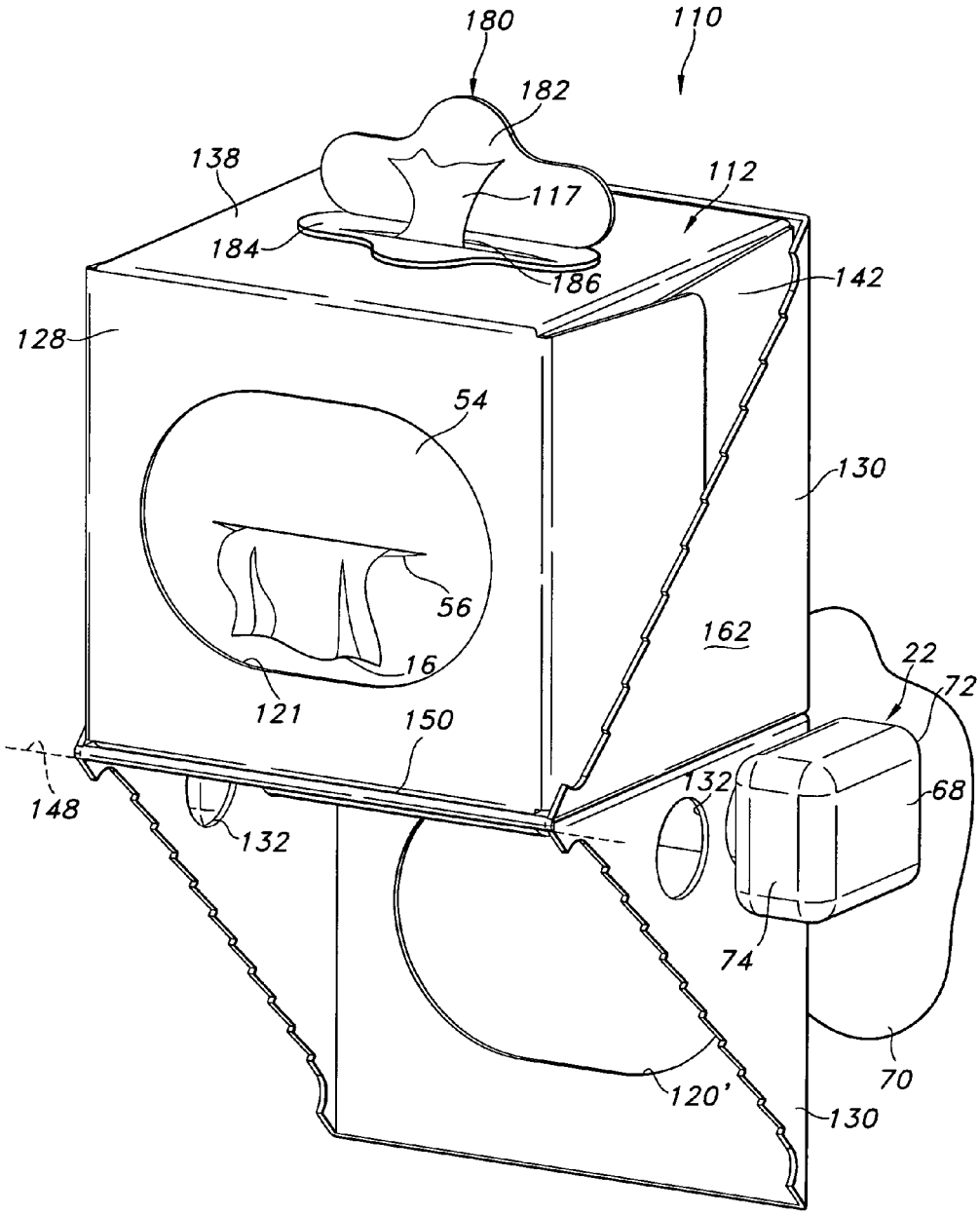
FIG. 7 is a prespective view of the dispenser of FIG. 6, showing the dispenser in its dispensing position releasably coupled to a roll mount of a conventional rolled product fixture for dispensing dry sheets and premoistened sheets therefrom.
Figure 8:
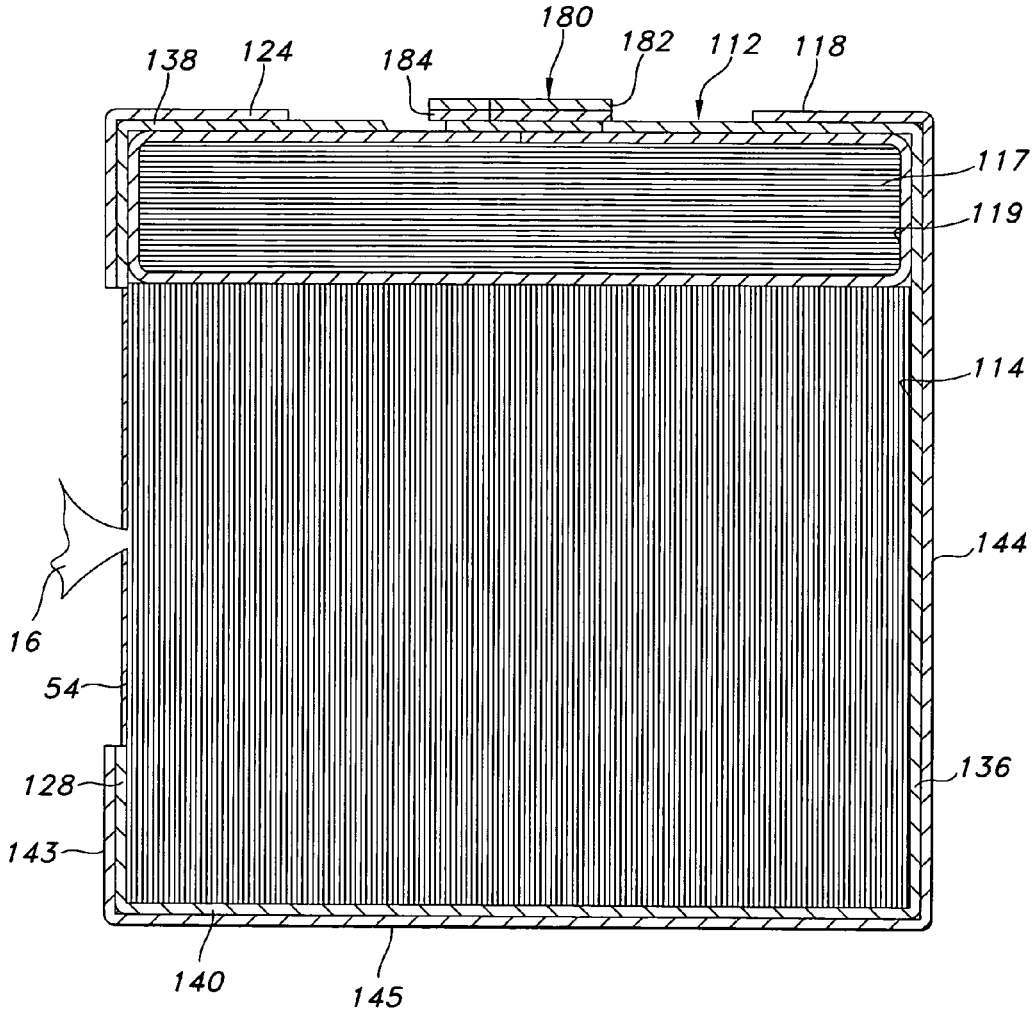
FIG. 8 is a sectional view of FIG. 6 taken along line 8—8.

In another embodiment of the invention, as illustrated in FIGS. 6–8, the dispenser 110 and housing 112 are very similar to the dispenser 10 and the housing 12 shown in FIGS. 1–5 and previously described in detail herein. The dispenser 110, however, is adapted to provide premoistened sheets 117 as well as dry sheets 16 in a compartment 114 of a single housing 112. The compartment 114 contains a group of dry sheets 16, which may also be provided in a cartridge (not shown). The compartment 114, as shown in FIG. 8, also includes, by way of example and not limitation, a container 119 of premoistened sheets 117 as well.

The container 119 of premoistened sheets 117 may be formed as a separate container 119. Alternatively, however, the container 119 of premoistened sheets 117 may be provided as a portion of a cartridge of dry sheets (not shown), or it may be provided as a separate container with a separate cartridge of dry sheets (not shown). The premoistened sheets 117 are dispensed from the container 119 from an opening (not shown) in the container and through a first dispensing opening (not shown) in the housing 112, as shown in FIG. 7. The dry sheets 16 are dispensed from a second dispensing opening 121 in the housing 112, as illustrated in FIGS. 6 and 7.

The housing 112, as shown in FIGS. 7 and 8, includes front and back walls 128, 136 and upper and lower ends 138, 140. Sidewalls 142 cooperate with the front and back walls 128, 136 and the upper and lower ends 138, 140 to provide the housing 112. A platform or support member 118 is positioned over the housing 112 in a manner similar to the one described previously herein. The support member, as shown in FIGS. 6–8, includes an upper surface 124 which is positioned adjacent spaced-apart sidewalls 130. The support member also includes a front wall 143 that is provided adjacent the upper surface 124 and a back wall 144 positioned adjacent the back wall 136 of the housing 12. The support member 118 may include other structures, such as a lower end 145 which is positioned over and attached to the lower end 140 of the housing 112. The support member 118 may pivot on an axis 148 provided at a junction 150 of the lower end 145 and the front wall 143 of the support member 118. Such pivotable movement is provided by sufficiently resilient material in at least this portion of the support member 118, by a hinge, such as a living hinge (not shown), and so forth.

As illustrated in FIGS. 6–8, the first dispensing opening (not shown) may be provided, by way of non-limiting example, in an upper end 138 of the housing 112; a first opening 120' is positioned in the support member 118 and aligned over the first dispensing opening. A portion of the container 119 of premoistened sheets 117 is exposed through the first dispensing opening, which provides access thereto. The dry sheets 12 are dispensed from a second dispensing opening 121, by way of non-limiting example, in the front wall 128 of the housing 112. A second opening 121' is positioned in the support member 118 and aligned over the second dispensing opening 121.

As shown in FIGS. 6–8, a resealable cover 180 may be positioned over the first dispensing opening (not shown) in the housing 112 which is aligned with the opening (not shown) in the container 119 of premoistened sheets 117. The premoistened sheets 117 are then accessed through the resealable cover 180 and first dispensing opening (not shown) in the housing 112, to permit dispensing of the premoistened sheets 117 from the dispenser 110. Alternatively, or, in addition thereto, the container 119 may also include a resealable cover 180 which is aligned with the first dispensing opening of the housing to permit access to the premoistened sheets as well (not shown).

The resealable cover 180 is used to maintain the moisture conditions within the container and to prevent undesired drying out of the premoistened sheets 117. In a non-limiting example of one possible resealable cover, FIGS. 6–8 disclose a resealabe cover 180 which includes an upper flap 182 which is coupled to a portion of a lower flap 184, which has a slit or opening 186 therein, through which the premoistened sheets 117 are withdrawn. The resealable cover 180 in this embodiment is positioned over the first dispensing opening (not shown) of the housing 112. The upper flap 182 releasably engages the lower flap 184 to provide a releasable closure to the housing 112 and the container 119. Such releasable and resealable features between the upper and lower flaps 182, 184 is provided, by way of non-limiting example, by an adhesive, such as a pressure sensitive adhesive, a cohesive adhesive, such as a latex or other natural rubber material, and so forth. Other resealable mechanisms, such as, by way of non-limiting example, snap-fit, hinged cover and lid, and so forth are known and may be used; any resealable mechanism known in the art may be used with any dispensing opening in the housing and/or any opening in the container.

The dispenser 110 may be disposed on a generally horizontal surface 52, such as, by way of non-limiting example, a table top, to permit dry sheets 16 and premoistened sheets 117 for use, for example, as facial tissue, and so forth, to be dispensed therefrom, as shown in FIG. 4. The dispenser 110 may be turned such that either dry sheets 16 or premoistened sheets 117 may be dispensed from an upper or most superior portion of the dispenser 110. The dispenser 110, similarly to dispenser 10, may be easily converted into a dispenser which may be easily and releasably coupled to a conventional rolled product dispenser for dispensing dry sheets 16 for use as bath issues and premoistened sheets 117, as illustrated in FIG. 7.

When the release strip 158 is pulled, it again separates a portion of the sidewalls 130, as previously described herein. The upper surface 124, the front wall 143, and an adjacent first triangular portion 162 separate from the sidewall 130 and the housing 112, and pivot on the axis 148 which permits the upper surface 124 of the support member 118 to pivotably move such that the front wall 143 of the support member 118 is moved against the lower end 140 of the housing 112, as shown in FIG. 7. Desirably, the peel strip 160 is removed prior to pivotably moving the support member 118, so that the front wall 143 will be adhesively connected or bonded to the lower end 138 of the housing 112. The degree of pivotable movement or rotation is identical to that previously described herein. The first triangular portion 162 of each sidewall 130 has at least one aperture 132 therein, to permit the support member 118 of the dispenser 110 to be releasably coupled to the fixture 22, in a manner previously shown and/or described herein.

The dispenser 110 and the housing 112 includes all characteristics and/or features previously shown and/or described for the dispenser 10 and the housing 12, and so forth. Moreover, the housing 112 may be non-refillable, or it may be refillable. The housing 112 may be constructed from any material shown and/or described herein. The housing 112 may also include a peel strip 160.

As illustrated in FIG. 8, the housing 112 desirably is an integral unit such that the compartment 114 contains the group of dry sheets 16 (or cartridge of dry sheets) and the container 119 of premoistened sheets 117. However, alternatively, the housing 112 may include first and second compartments formed separately such that one compartment holds dry sheets and another compartment holds the container of premoistened sheets (not shown). Such compartments may be delineated by separate cartridges or containers, or, by way of non-limiting example, the housing may have at least a portion of an inner wall (not shown) in which to provide first and second compartments (not shown).

The premoistened sheets 117 may be encased in a liquid impermeable film, and this film may provide a portion, or all, of the container 119 as shown in FIG. 8. In a further example, the container 119 may be formed from at least one other material, and the container 119 may be lined with the film (not shown).

It will be understood that the position of the premoistened 117 and dry sheets 16 within the housing 112 may be reversed, and they need not be in a specific configuration, and may take on any suitable arrangement, including a stacked arrangement, a side-by-side arrangement, a coaxial arrangement, and so forth. Any number of configurations may be used for simultaneously dispensing dry and premoistened sheets from a single housing. All such configurations are within the scope and spirit of the present invention.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to dispense sheets as a table top dispenser and convertible into a dispenser configured to dispense sheets from a rolled product fixture, the dispenser comprising:

a housing having sheets provided therein and at least one opening oriented to dispense sheets therefrom, the housing configured to be positioned on a horizontal surface, the housing including a platform positioned thereover and the platform having an initial position appearing as at least a portion of the housing, the dispenser converted into a dispenser for dispensing sheets from the rolled product fixture when the platform is released and pivotably moved on an axis, a portion of the platform is positioned against the housing such that the housing is supported above the platform on the rolled product fixture for dispensing sheets therefrom.

2. The dispenser of claim 1, wherein the platform includes at least two openings which permit it to couple to the rolled product fixture.

3. The dispenser of claim 2, wherein the rolled product fixture includes at least a pair of spaced-apart support arms having a roll mount extending therebetween, the roll mount being positionable through the openings in the platform to couple the platform thereto.

4. The dispenser of claim 1, wherein the platform includes a release member which is one of a release strip, a tear strip and an adhesive seal, wherein when the release member is removed, the platform is released from the initial position and is pivotable into the support position below the housing.

5. The dispenser of claim 1, wherein the platform cam rises an upper surface and spaced apart sidewalls, and the upper surface includes a seal covering an adhesive.

6. The dispenser of claim 5, wherein when the seal is removed, the adhesive is positioned to hold the platform against a lowest end of the housing when the platform is pivotably moved into the support position below the housing.

7. The dispenser of claim 1, wherein the housing is non-refillable.

8. The dispenser of claim 7, wherein the housing is constructed from paperboard, cardboard, plastic, and combinations thereof.

9. The dispenser of claim 1, wherein the housing is refillable and constructed from wood, plastic, metal, and combinations thereof.

10. The dispenser of claim 1, wherein the platform is pivotably moved at least 180 degrees.

11. The dispenser of claim 10, wherein the platform is pivotably moved at least 200 degrees.

12. The dispenser of claim 11, wherein the platform is pivotably moved at least 250 degrees.

13. The dispenser of claim 12, wherein the platform is pivotably moved about 270 degrees.

14. The dispenser of claim 1, wherein a width dimension between a pair of spaced wart support arms of the rolled product fixture is in a range of about 6.0 inches to about 4.0 inches.

15. The dispenser of claim 14, wherein a width dimension of a portion of the platform which releasably couples to a rail mount extending between the support arms is in a range of about 5.5 inches to about 4.7 inches.

16. The dispenser of claim 15, wherein the width dimension of the portion of the platform is about 5.25 inches to about 4.6 inches.

17. The dispenser of claim 16, wherein the width dimension of the portion of the platform is about 5.25 inches to about 4.5 inches.

18. The dispenser of claim 1, wherein a resealable cover is positioned over a dispensing opening.

19. The dispenser of claim 1, wherein the housing contains one of dry sheets, premoistened sheets, and both dry and premoistened sheets.

20. The dispenser of claim 1, wherein a width dimension between a pair of spaced apart support arms of the rolled product fixture is in a range of about 6.0 inches to about 4.0 inches.

21. The dispenser of claim 20, wherein width dimension of a portion of the platform which releasably couples to a roll mount extending between the support arms is in a range of about 5.5 inches to about 4.7 inches.

22. A dispenser adapted to dispense sheets as a table top dispenser and convertible into a dispenser configured to dispense sheets from a rolled product fixture, the dispenser comprising:

a non-refillable housing having sheets provided therein and at least one opening oriented to dispense sheets therefrom, the housing configured to be positioned on a horizontal surface, the housing including a platform positioned thereover and the platform having an initial position appearing as at least a portion of the housing, the platform adapted to be coupled to the rolled product fixture, the dispenser converted into a dispenser for dispensing sheets from the rolled product fixture when the platform is released from the initial position and pivotably moved on an axis more than 180 degrees and positioned against the housing such that the housing is supported above the platform and a portion of the platform is positioned against a lowest portion of the housing, the housing being positioned above a substantial portion of a the rolled product fixture for dispensing sheets therefrom when the platform is releasably coupled thereto.

23. The dispenser of claim 22, wherein the platform includes at least two openings which permit it to couple to the rolled product fixture, and wherein the rolled product fixture includes at least a pair of spaced-apart support arms having a roll mount extending therebetween and positionable through the openings in the platform to couple the platform to the support arms.

24. The dispenser of claim 22, wherein the platform includes a release member which is one of a release strip, a tear strip and an adhesive seal, wherein when the release member is removed, the platform is released from the initial position and is pivotable into the support position below the housing.

25. The dispenser of claim 22, wherein the platform comprises an upper surface and spaced apart sidewalls, and the upper surface includes a seal covering an adhesive, and when the seal is removed, the adhesive is positioned to hold the platform against a lowest end of the housing when the platform is pivotably moved into the support position below the housing.

26. The dispenser of claim 22, wherein the housing is constructed from paperboard, cardboard, plastic, end combinations thereof.

27. The dispenser of claim 22, wherein the platform is pivotably moved at least 200 degrees.

28. The dispenser of claim 27, wherein the platform is pivotably moved at least 250 degrees.

29. The dispenser of claim 28, wherein the platform is pivotably moved about 270 degrees.

30. The dispenser of claim 22, wherein the housing contains one of dry sheets, premoistened sheets, and born dry and premoistened sheets.

31. The dispenser of claim 22, wherein a resealable cover is positioned over a dispensing opening.

32. A dispenser for dispensing sheets from a table top and convertible into a dispenser configured to dispense sheets from rolled product fixture, the dispenser comprising:

a housing which includes dry sheets and premoistened sheets disposed therein and dispensing openings oriented to dispense the dry sheets and the premoistened sheets therefrom, the housing configured to be positioned on a horizontal, the housing including a platform having openings therein, the platform positioned over at least a portion of the housing and the platform having an initial position appearing as at least a portion of the housing, the dispenser converted into a dispenser for dispensing from the rolled product fixture when the platform is released from the initial position and is pivotably moved on an axis and positioned below and against the housing such that the housing is supported above the platform and a portion of the platform is positioned against a lowest portion of the housing, the openings in the platform permitting it to be coupled to a portion of a the rolled product fixture.

33. The dispenser of claim 32, wherein the rolled product fixture includes at least a pair of spaced-apart support arms having a roll mount extending therebetween and the roll mount is positioned through the openings in the platform to couple the platform to the support arms.

34. The dispenser of claim 32, wherein the platform includes a release member which is one of a release strip, a tear strip and an adhesive seal, wherein when the release member is removed, the platform is released from the initial position and is pivotable into the support position below the housing.

35. The dispenser of claim 32, wherein the platform comprises an upper surface and spaced apart sidewalls, and the upper surface includes a seal covering an adhesive, and when the seal is removed, the adhesive is positioned to hold the platform against the lowest end of the housing when the platform is pivotably moved into the support position below the housing.

36. The dispenser of claim 32, wherein the platform is pivotably moved at least 200 degrees.

37. The dispenser of claim 36, wherein the platform is pivotably moved at least 250 degrees.

38. The dispenser of claim 37, wherein the platform is pivotably moved about 270 degrees.

39. The dispenser of claim 32, wherein a resealable cover is positioned over the dispensing opening for the premoistened sheets.

40. A dispenser comprising:

a housing having an inner box, an outer box, and at least one dispensing opening; the outer box having at least one release strip enabling a platform section that is hingedly attached to the housing to pivot from an initial position as a portion of the outer box to a support position beneath the housing.

41. The dispenser of claim 40 wherein the platform comprises an upper surface, a back wall, a first triangular portion, and a second triangular portion opposite the first triangular portion; and each triangular portion having at least one opening to enable the dispenser to be attached to a spindle of a rolled product fixture.

42. The dispenser of claim 41 comprising a release strip located adjacent to each triangular portion on a sidewall of the outer box.

43. The dispenser of claim 42 wherein the platform section comprises one-half of the outer box.

44. The dispenser of claim 41 wherein each triangular portion includes two openings.

45. The dispenser of claim 41 wherein the upper surface of the platform comprises an adhesive for securing the platform in the support position to the housing.

46. The dispenser of claim 40 wherein the inner box contains dry sheets.

47. The dispenser of claim 40 wherein the inner box comprises a compartment housing dry sheets having a dispensing opening, and a container housing premoistened sheets having a dispensing opening.

* * * * *